US007404749B2

(12) United States Patent
Cheung

(10) Patent No.: US 7,404,749 B2
(45) Date of Patent: Jul. 29, 2008

(54) MULTI-LAYER SPORTS BOARD WITH GRAPHIC IMPRINTED SKIN

(76) Inventor: Wah Kan Cheung, 55 Doncaster Ave., Suite 102, Thornhill, Ontario (CA) L3T 1L7

( * ) Notice: Subject to any disclaimer, the term of this patent is extended or adjusted under 35 U.S.C. 154(b) by 108 days.

(21) Appl. No.: 11/431,453

(22) Filed: May 10, 2006

(65) Prior Publication Data

US 2007/0264891 A1 Nov. 15, 2007

Related U.S. Application Data

(63) Continuation-in-part of application No. 10/958,913, filed on Oct. 5, 2004.

(60) Provisional application No. 60/789,614, filed on Apr. 5, 2006.

(51) Int. Cl.
*B63B 1/00* (2006.01)

(52) U.S. Cl. ..... 441/74; 441/65

(58) Field of Classification Search ..... 441/65
See application file for complete search history.

(56) References Cited

U.S. PATENT DOCUMENTS

| | | | | |
|---|---|---|---|---|
| 4,850,913 | A * | 7/1989 | Szabad, Jr. | 441/65 |
| 5,647,784 | A * | 7/1997 | Moran | 441/65 |
| 6,955,576 | B2 * | 10/2005 | Yeh | 441/65 |
| 7,029,349 | B2 * | 4/2006 | Lin | 441/65 |
| 7,150,666 | B2 * | 12/2006 | Cheung | 441/74 |

* cited by examiner

*Primary Examiner*—Jesús D Sotelo
(74) *Attorney, Agent, or Firm*—Clement Cheng

(57) ABSTRACT

A sports board comprises a foam core with a top surface, a bottom surface and edge surfaces. A top layer is heat laminated to the top surface and edge surfaces of the foam core. The top layer has a first plastic film having a top surface and a bottom surface. A first adhesive resin film has a top surface and a bottom surface. The top surface is heat laminated to the bottom surface of the first plastic film and the bottom surface heat laminated to the top surface and edge surfaces of the foam core. A bottom layer is heat laminated to the bottom surface of the foam core.

33 Claims, 6 Drawing Sheets

MULTI-LAYER SPORTS BOARD WITH GRAPHIC IMPRINTED SKIN

This application is a continuation in part of copending Wah Kan Cheung's application for Multi-layered sports board Ser. No. 10/958,913 filed Oct. 5, 2004. This application also claims priority from provisional application U.S. application No. 60/789,614 filed Apr. 5$^{th}$, 2006.

TECHNICAL FIELD

The present invention relates to foam sports boards for recreational use and, more particularly, to a laminated gliding board with improved bonding characteristics.

DISCUSSION OF RELATED ART

Polyethylene foam sports boards have recently become very popular, in particular in the application as snow sleds, bodyboards, surfboard and other kinds of gliding boards or the like. However, one drawback in using a polyethylene foam sports board is that it does not have the desirable stiffness against the flex of the foam board caused by the weight of the rider and this impairs the maneuverability of the sports board. For example, in the application of snow sled, such deformation of the board will result in the foam sled submerging below the snow surface and thereby reduce the sliding speed and directional stability when carrying a rider sliding down a snow-covered slope.

Some manufacturers try to produce a polyethylene foam board with higher flexural strength by increasing the thickness or density of foam core, or by laminating a thick polymer film outside the foam board. Yet this increases the weight of foam board degrading desirable performance in its applications as a snow sled or bodyboard. It is more desirable to have a foam sled or a bodyboard having higher flexural strength without increase in weight.

Polystyrene foam core has been used to produce foam sports boards due to its lightweight and rigid properties. However, there are some drawbacks associated with a polystyrene foam core. For example, in the case of snow sled application, a polystyrene foam core does not provide the same degree of comfort in terms of cushioning and shock absorption properties when compared with a polyethylene foam core. It may be desirable to develop a sports board with a rigid polystyrene foam core and desirable resilient and shock absorption properties of polyethylene foam in the top and front portion of the board.

A traditional foam sports board such as snow sled or a bodyboard in general includes a polyethylene foam skin with some kinds of graphic or logo printed thereon for decoration purpose. One conventional printing technique is by silkscreen printing compatible ink on the polyethylene foam skin. The pattern is printed on the outer surface of the foam board and thus is exposed to wear and tear by the effect of mechanical rubbing, water, heat and sunlight in use. Therefore, the pattern will fade or worn off quickly. It is obviously desirable to have a protective layer covering the entire foam skin to prevent the graphic printed on the foam skin to be worn out easily and yet still allow the pattern to be visible outside the protective layer.

Polyethylene foam sports boards with graphic imprinted plastic film outer layer are known in the prior art. In general, such boards are composed of a number of polyethylene foam and polyethylene film layers that are laminated together by heating the film and foam layers and then immediately passing them through a pair of nip rollers. Schneider of U.S. Pat. No. 5,211,593 has disclosed such a laminating process.

Schneider discloses that graphics are first imprinted as ink on the inner surface of the outer plastic film that is transparent. Then the imprinted outer film is adhesively bonded to an inner plastic film. The surface of foam plank is heated to a temperature range of 180° F. to 220° F. and the resulting dual-layered film is pressed onto the heated surface of the foam plank by a pair of nip rollers. Because the standard foam core does not have a perfectly flat or planar surface, bonding between the film and foam core is limited to the apexes of the cells on the surface of the foam core. Thus the point of contact is not uniform between the film and foam, but instead the film contacts the points of the outer surface of the core that protrude from the irregular cellular surface of the foam core.

Another conventional process of lamination is to apply heat to the film layer with a heated nip roller, which, in most cases, contains an engraved pattern of convex and concave area for better heat transfer. This type of roller with engraved convex and concave pattern is commonly known as embossing roller. Bonding of polyethylene film to polyethylene foam substrate is caused by the localized collapse and bonding of the foam cells on the surface of film at the concave depressed area where the foam substrate is under the combined influence of heat and pressure of the heated embossing roller. Typically micro-cellular high-density foam sheets are used to improve the adhesion between the film and foam core. The micro-cellular foam sheet contains smaller peaks and valleys, with the peaks closer together. The surface area of contact between the sheet and foam is thereby increased. However, this kind of structure is still prone to delamination by mechanical contact, effect of water, moisture and forces when in use simply because the interface between the film and foam layers contain unbonded area. The resulting laminate of the polyethylene foam and polyethylene film is then often heat laminated onto a standard foam core. The polyethylene film may comprise an outer film layer and an inner film layer having a graphic image imprinted on one surface interposed between the outer film layer and the inner film layer.

One prior art is found in U.S. Pat. No. 4,850,913, which discloses a manufacturing process of heat laminating a polyethylene film layer to a thin sheet of polyethylene foam which is then further heat bonded to the foam core of the board. It is accordingly desirable to provide a laminating system to make a foam sports board with graphic imprinted outer film layer and the film layer is adhered to the foam core with improved bonding characteristics.

Patent U.S. Pat. No. 5,211,593 shows a prior art technique to laminate a dual-layered graphic film to a foam substrate. The laminating process involves two steps. Step one is to adhesively bond the graphic imprinted outer film with the inner film using conventional glue or adhesive. Step two is heat laminating the resulting dual-layered graphic film to a foam substrate. It would be advantageous to provide an improved laminating system that can laminate a graphic imprinted film directly to a foam substrate in one single process with improved bonding characteristics.

While it is known in the prior art that a thin layer of thermal plastic polyethylene film between a polyethylene foam sheet and a polyethylene film can be used to promote lamination, such thin layer of film is generally an unmodified low-density polyethylene with limited efficacy. Accordingly, there is need for adhesively bonded sports boards with improved bonding between layers of different polymeric material having different surface contouring and cellular structure.

SUMMARY OF THE INVENTION

The present invention provides the solution to the above-mentioned problem by introducing an adhesive resin film layer between a plastic film and a foam substrate in a multi-layered sports board. The sports board comprises a foam core having a thickness generally in the range of 0.2 inch to 4 inches. Suitable foam board may include any plastic foam known in the art such as expanded polyethylene (EPE) foam, expanded polypropylene (EPP) foam, expanded polystyrene (EPS) foam, expanded ethylene vinyl acetate (EVA) foam, polyisocyanurate foam, polyurethane foam and expanded polyolefin foam. Polyolefin foams may further include homopolymers and copolymers of ethylene, propylene, styrene, and ethylene vinyl acetate as well as blends of such homopolymers and copolymers. The foam core can be fabricated from an extruded foam board and molded bead foam in non cross-linked type or cross-linked type. The present invention is particularly useful with extruded polyethylene foam. Such foam is lightweight and resilient with relatively low manufacturing cost. The foam core may also be a composite core made by laminating two or more layers of foam sheets.

An expanse of skin is heat bonded to the foam core at the top and bottom surfaces. The skin comprises laminate of plastic film and polyolefin foam sheet. The skin may include a layer of plastic film material, such as extruded polyethylene, a polyolefin foam sheet, and an adhesive resin film layer disposed underside for heat bonding the plastic film with the polyolefin foam. The bottom surface of the polyolefin foam is heat bonded to the top surface and edge surface of the foam core. The thickness of the plastic film layer is generally in the range of 0.01 mm to 0.15 mm. The plastic film may be transparent and include graphic images formed on the inner surface facing the adhesive resin film layer. The graphic images can be visible outside the plastic film. The plastic film layer preferably has the same polymer composition as the foam sheet. With the intermediate layer of adhesive resin, the plastic film need not be of the same polymer composition as the foam sheet. The plastic film may be a monolayer structure or a multilayer structure. A sheet co-extrusion process may be used to make the multilayer laminate of plastic film and adhesive resin film. Preferred plastic film is a polyolefin film and polyethylene film is typically used for the present application. Polyethylene film is a common plastic film and graphic images can be printed on it by conventional printing technique well known in the art.

The polyolefin foam sheet may also include graphic images formed on the outer surface of the polyolefin foam sheet facing the adhesive resin film layer. The polyolefin foam sheet has a thickness in the range of 2 to 8 mm and a density in the range of 4 to 10 lb/ft$^3$. Polyolefin foams may include homopolymers and copolymers of ethylene, propylene, styrene, and ethylene vinyl acetate as well as blends of such homopolymers and copolymers. The foam sheet can be fabricated by extrusion or beaded foam molding in noncross-linked type or cross-linked type. The polyolefin foam sheet may also be a monolayer structure or a multilayer structure. Both polyethylene foam and polypropylene foam are suitable, but cross-linked polyethylene is particularly useful for the present invention. Such foam sheet has very fine cell structure and smooth skin surface that is desirable for printing graphic images.

The adhesive resin film layer may be selected from a group consisting of anhydride-modified ethylene/vinyl acetate, ethylene/propylene copolymer, homogeneous ethylene/alpha-olefin copolymer, anhydride-modified polyolefin, ethylene/acrylic acid copolymer, vinyl acetate/acrylic copolymer, ethylene/methylacrylate copolymer, ethylene/vinyl acetate copolymer, and blends of the foregoing, may be employed. Grafting with an anhydride polymer may modify these adhesive resin polymers and improve its adhesive bonding characteristics. These adhesive resins facilitate the bonding of various plastic film and foam substrate. In particular, these adhesive resin provide superior adhesive bonding in bonding a polyolefin foam layer to a polyolefin film layer or another polyolefin foam layer; whereby the two layers may have like or different polymer composition. Furthermore, these adhesive resins are capable of bonding the polymer material of the ink resin generally applied on polyolefin film for graphic printing. Therefore the adhesive resin are particularly useful in bonding a polyolefin foam layer to a graphic imprinted polyolefin film; and alternatively bonding a graphic imprinted polyolefin foam layer to a polyolefin film, the ink coated surface bonded to the adhesive resin layer. It is believed that such superior bonding is the result of the intermediate layers having a lower melt temperature than other materials, low shear viscosity, good wetting characteristics that diffuses quickly and forms a thin coating film layer with intimate adhesion bonding over the entire interface.

In another embodiment, the plastic film comprises an outer layer of transparent plastic film and an inner layer of a second plastic film. The outer layer of transparent plastic film may include graphic images formed on the inner surface facing the adhesive resin film layer. The graphic images can be visible outside the plastic film.

DETAILED DESCRIPTION OF THE PREFERRED EMBODIMENTS

Figure 1:
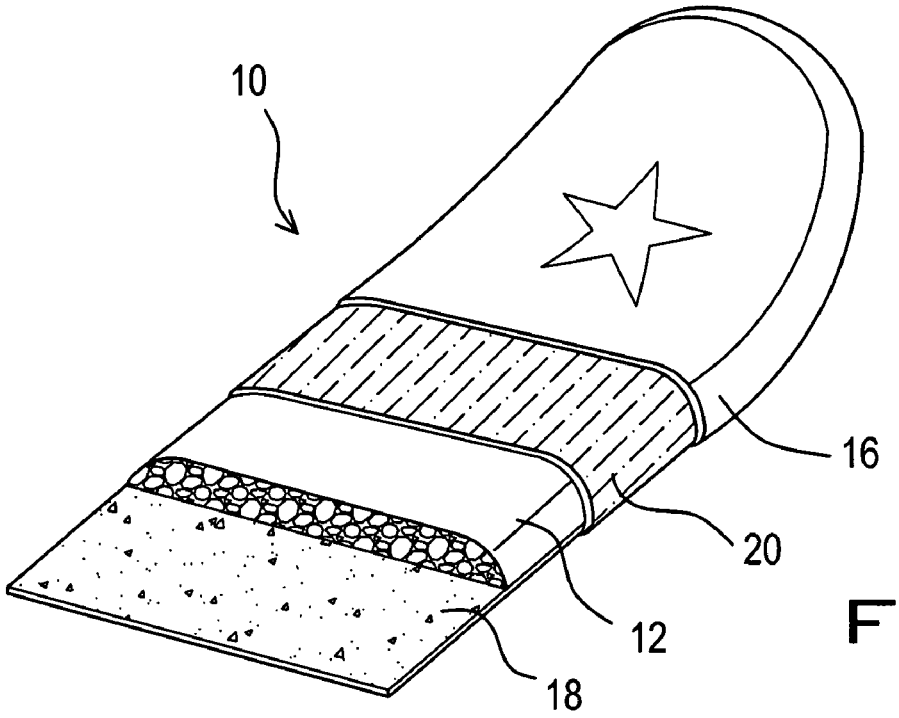
FIG. 1 is a partially exploded perspective view of a sports board according to a first embodiment of the present invention.

With reference to FIG. 1, a sports board 10 according to the first embodiment of the present invention comprises a foam core 12, a plastic film 16, a first pattern, and a bottom sheet 18. Foam core 12 has a thickness of between 0.5 and 2.5 inches, and preferably a thickness of 1 inch. Foam core 12 has a density in the range of 1.5 to 4 lb/ft$^3$, and preferably a density of 2.2lb/ft$^3$. The plastic film is a graphically-imprinted polyolefin film. The graphics on layer 16 are imprinted using any of several conventional processes for printing. An example of such a process is corona printing, in which an electrical discharge temporarily alters the surface molecules of the polyethylene film, allowing inks to adhere to the film. Layer 16 has a thickness of between 0.02 mm and 0.15 mm, and preferably a thickness of 0.07 mm. Layer 16 has a density in the range of 0.89 to 0.98 g/cm$^3$, and preferably a density of 0.95 g/cm$^3$. The bottom sheet 18 is made of polyethylene sheet and provides an outer slick running surface of the board for reducing friction and while increasing its mechanical strength. Sheet 18 has a thickness of between 0.1 and 2 mm, and preferably a thickness of 0.5 mm and a density in the range of 0.89 to 0.98 g/cm$^3$, and preferably a density of 0.95 g/cm$^3$.

In the preferred embodiment, adhesive layer 20 is an anhydride-modified ethylene vinyl acetate. Layer 20 has a thickness of between 0.01 and 0.20 mm, and preferably a thickness of 0.07 mm. Layer 20 has a density in the range of 0.88 to 0.98 g/cm$^3$, and preferably a density of 0.95 g/cm$^3$. It is contemplated that alternative adhesive resins may comprise ethylene/propylene copolymer, homogeneous ethylene/alpha-olefin copolymer, anhydride-modified polyolefin, ethylene/acrylic acid copolymer, vinyl acetate/acrylic copolymer, ethylene/methylacrylate copolymer, ethylene/vinyl acetate copolymer, and blends of the foregoing, may be employed. These adhesive resin polymers may be modified by grafting with an anhydride polymer.

Figure 12:
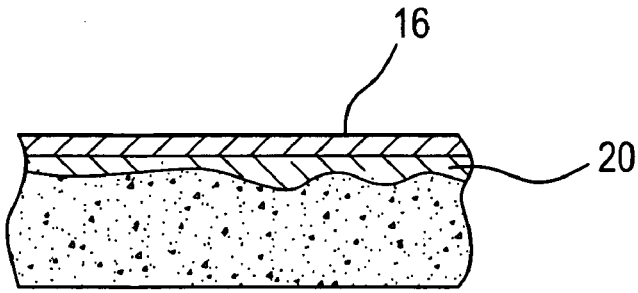
FIG. 12 is a cross sectional view of a laminate of the sports board showing an adhesive resin layer provides a smooth printing surface according to the present invention.

Such adhesive resin layer is selected so that its presence in the board provides not only the bonding between layers but also a smoother surface for printing a higher resolution graphic image to provide a refined sports board. See FIG. 12.

Figure 2:
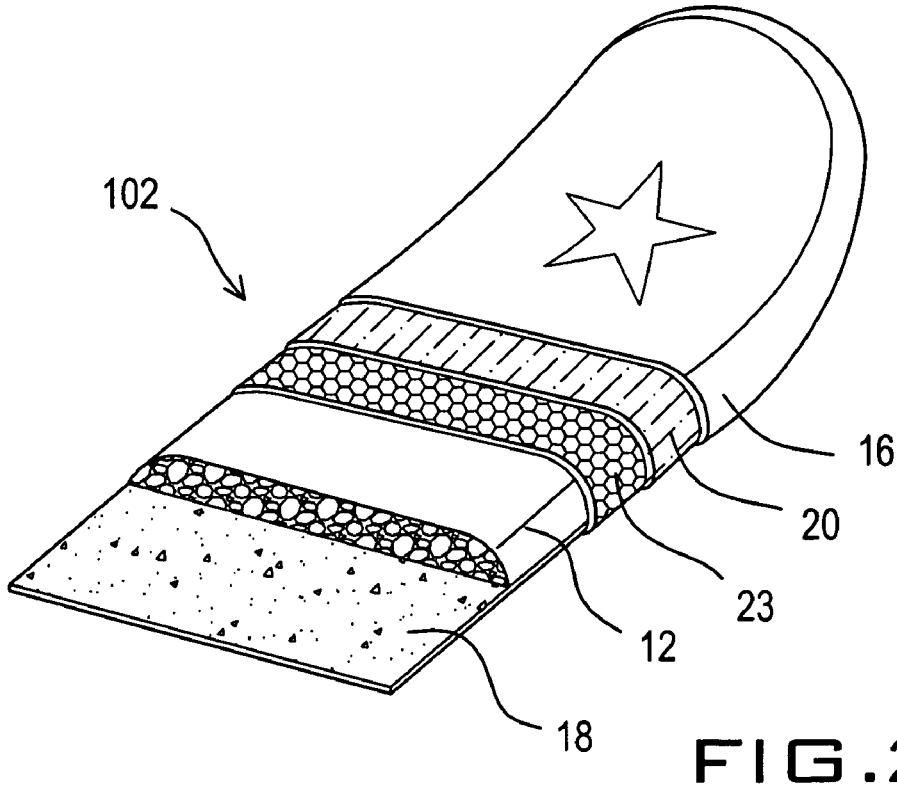
FIG. 2 is a partially exploded perspective view of a sports board according to a second embodiment of the present invention.

In FIG. 2, a sports board 102 according to a second embodiment of the present invention comprises five layers of material. The four layers are the same as the board 10 of FIG. 1 with an addition of layer 23 of polyethylene foam. Layer 23 has a thickness of between 1 and 5 mm, and preferably a thickness of 3 mm. Layer 23 has a density in the range of 4 to 10 lb/ft$^3$, and preferably a density of 6 lb/ft$^3$. Layer 16 is preferable a polyethylene film.

Figure 3:
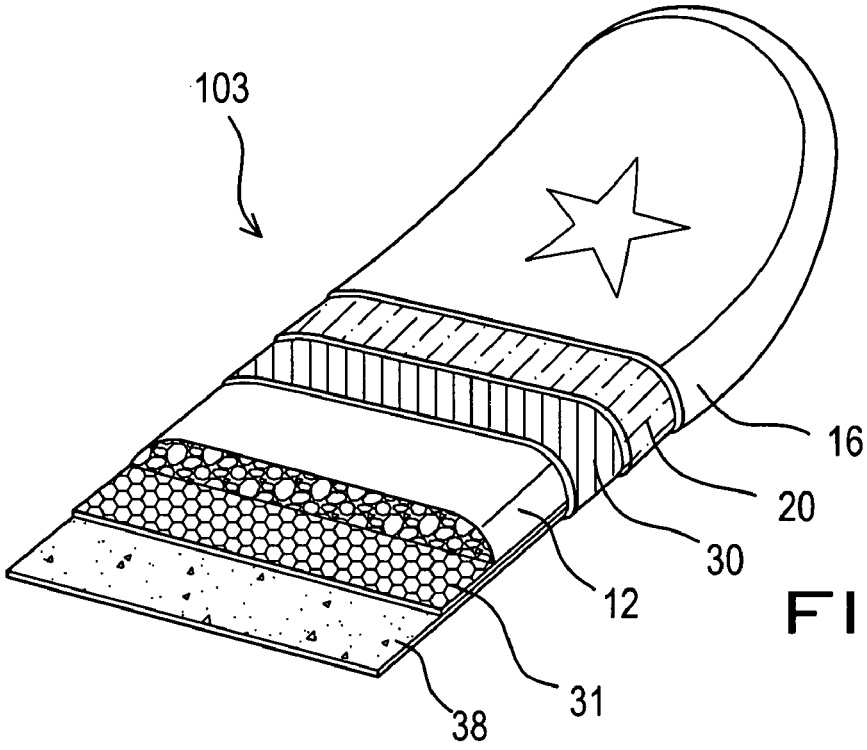
FIG. 3 is a partially exploded perspective view of a sports board according to a third embodiment of the present invention.

In FIG. 3, a sports board 103 according to a third embodiment of the present invention comprises six layers of material including the foam core 12, graphically-imprinted polyethylene film 16 and adhesive resin film 20 as used in the board 102 of FIG. 2. However, bottom sheet 38 is made of polyethylene into a thickness of between 0.1 and 2 mm, and preferably a thickness of 0.35 mm and a density in the range of 0.89 to 0.98 g/cm$^3$, and preferably a density of 0.95 g/cm$^3$.

Layer 30 is a closed-cell polyolefin foam sheet, preferable polypropylene foam sheet. Layer 30 has a thickness of between 1 and 5 mm, and preferably a thickness of 3 mm. Layer 30 has a density in the range of 4 to 10 lb/ft$^3$, and preferably a density of 6 lb/ft$^3$. Polypropylene foam has higher rigidity than polyethylene foam at similar density and provide a rigid shell structure to reinforce the foam board in this embodiment. An adhesive resin film layer (not shown in the drawing) is required to facilitate bonding between the polypropylene foam sheet 30 and the polyethylene foam core 12.

Between the polyethylene foam core 12 and the polyethylene sheet 38 is a polyethylene foam sheet 31, which has a thickness of between 1 and 5 mm, and preferably a thickness of 3 mm and a density in the range of 4 to 10 lb/ft$^3$, and preferably a density of 6 lb/ft$^3$.

Figure 4:
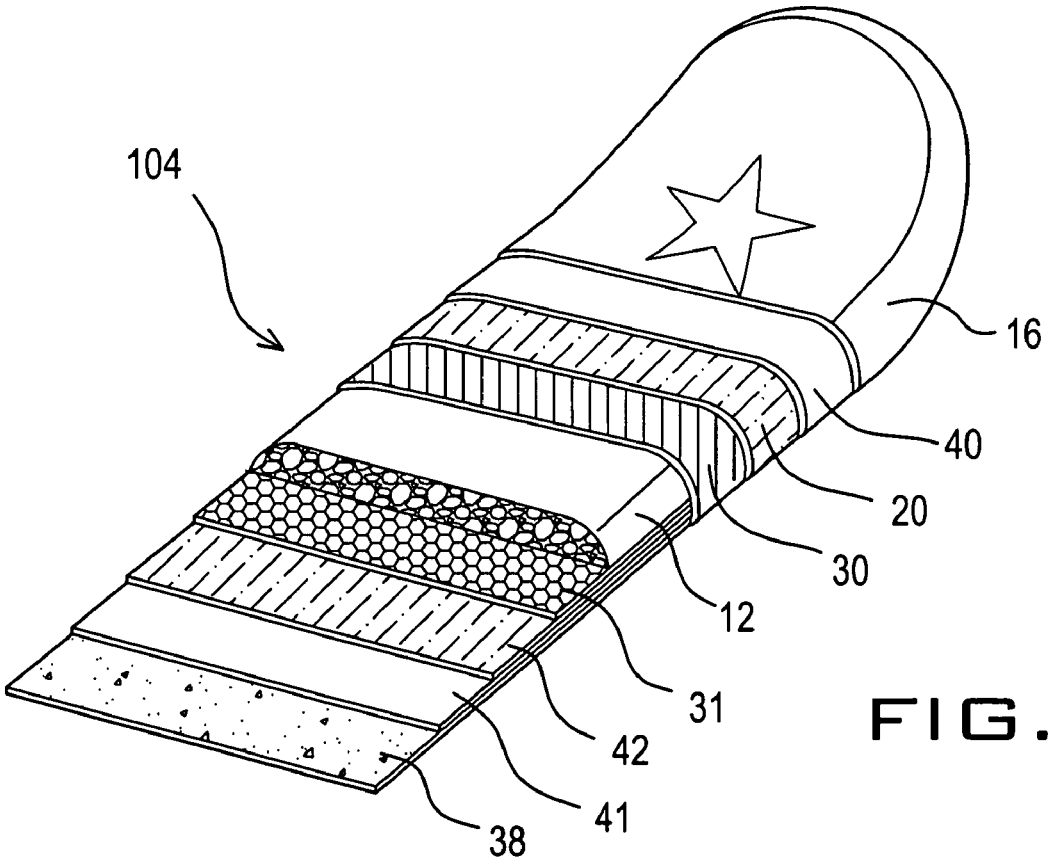
FIG. 4 is a partially exploded perspective view of a sports board according to a fourth embodiment of the present invention.

In FIG. 4, a sports board 104 according to a fourth embodiment of the present invention comprises nine layers of material including the five similar layers used in the board 103 of FIG. 3, namely the polyethylene foam core 12, graphically-imprinted polyethylene film 16, adhesive resin film 20, polypropylene foam sheet 30, polyethylene foam sheet 31 and polyethylene bottom sheet 38. Additionally, a second polyethylene film 40 is adhered to the underside of top polyethylene film 16. PE film 40 has a thickness of between 0.01 mm and 0.15 mm, and preferably a thickness of 0.07 mm. Layer 40 has a density in the range of 0.89 to 0.98 g/cm$^3$, and preferably a density of 0.95 g/cm$^3$.

On the upper side of the bottom polyethylene sheet 18 are a polyethylene film 41 and adhesive resin film 42. Polyethylene film 41 has the same thickness and density as PE film 16.

Figure 5:
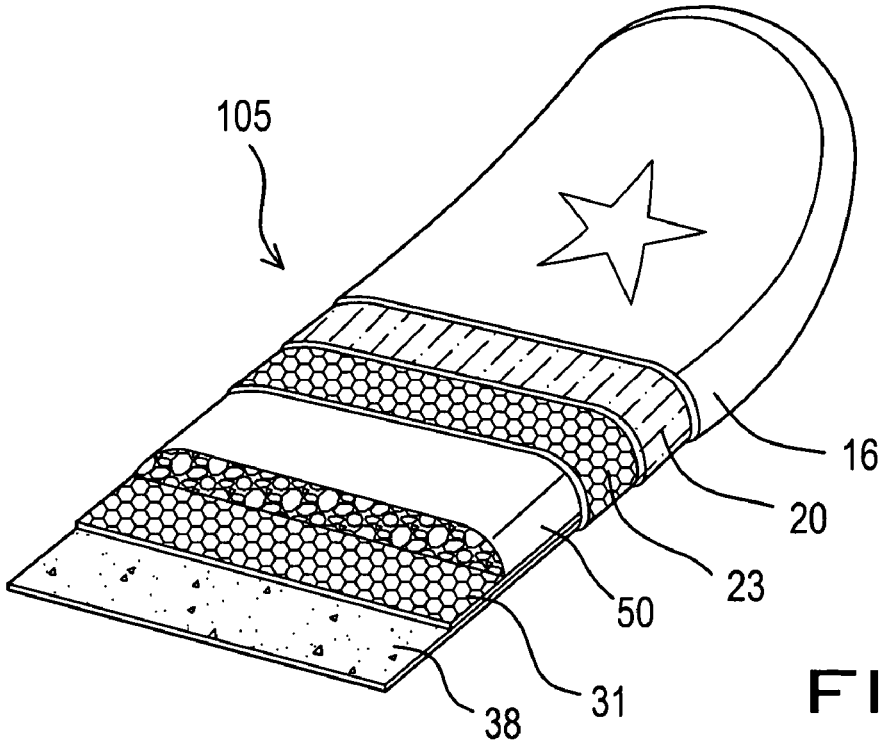
FIG. 5 is a partially exploded perspective view of a sports board according to a fifth embodiment of the present invention.

In FIG. 5, a sports board 105 of a fifth embodiment of the present invention comprises the top layers like those of the second embodiment including graphically-imprinted polyethylene film 16, adhesive resin film 20 and polyethylene foam layer 23. While its bottom layers include polyethylene foam sheet 31 and polyethylene bottom sheet 38 as in the third embodiment shown in FIG. 3.

In this embodiment, layer 50 is an expanded polystyrene (EPS) foam core. EPS foam has desirable properties of lightweight and rigid while polyethylene foam sheet provides a soft and resilient foam skin for comfort and shock absorbing in use. Foam core 50 has a thickness of between 0.5 and 2.5 inches, and preferably a thickness of 1 inch. Foam core 50 has a density in the range of 1.0 to 3 lb/ft$^3$, and preferably a density of 1.5 lb/ft$^3$. EPS foam core 50 is bonded to the top layers 16/20/23 and bottom layers 31/38 through respective adhesive resin films not shown in the drawing.

Figure 6:
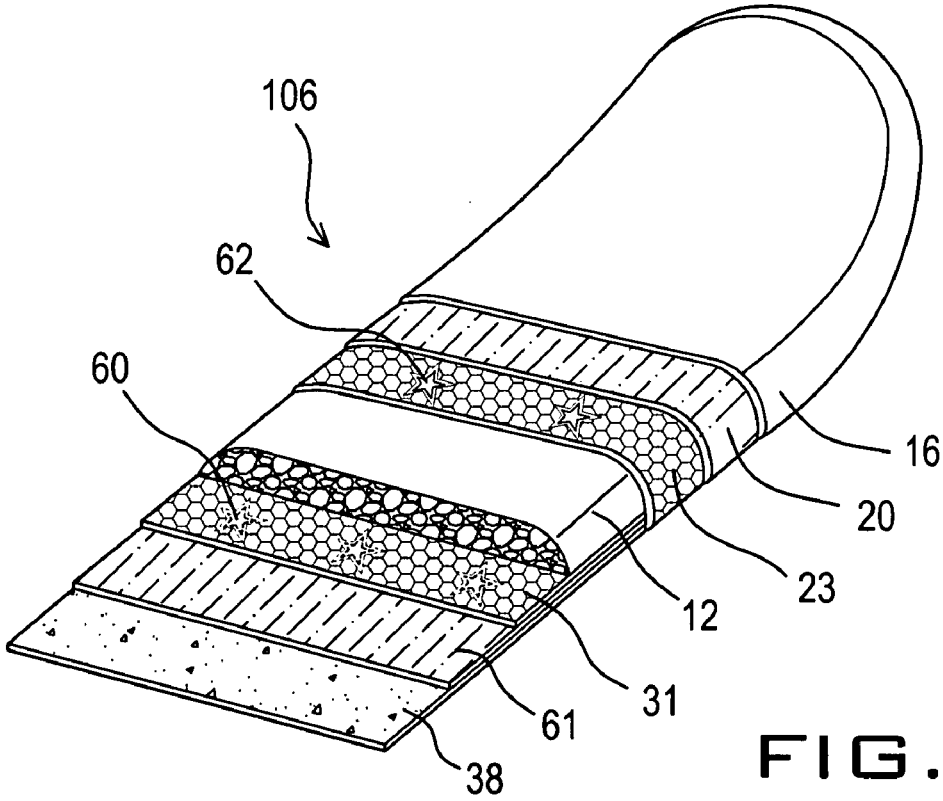
FIG. 6 is a partially exploded perspective view of a sports board according to a sixth embodiment of the present invention.

In FIG. 6, a sports board 106 of a fifth embodiment of the present invention comprises polyethylene foam core 12 and the top layers like those of the second embodiment including polyethylene film 16, adhesive resin film 20 and polyethylene foam layer 23. However, graphic 60 may be now imprinted on the outer surface of layer 23 for viewing from the top of the board 106. While its bottom layers include polyethylene foam sheet 31 and polyethylene bottom sheet 38 as in the third embodiment shown in FIG. 3 with an adhesive film 61 interposed between the two sheets 31 and 38. Another graphic 62 may be imprinted on the outer surface of sheet 31 for viewing from the bottom of the board 106.

Figure 7:
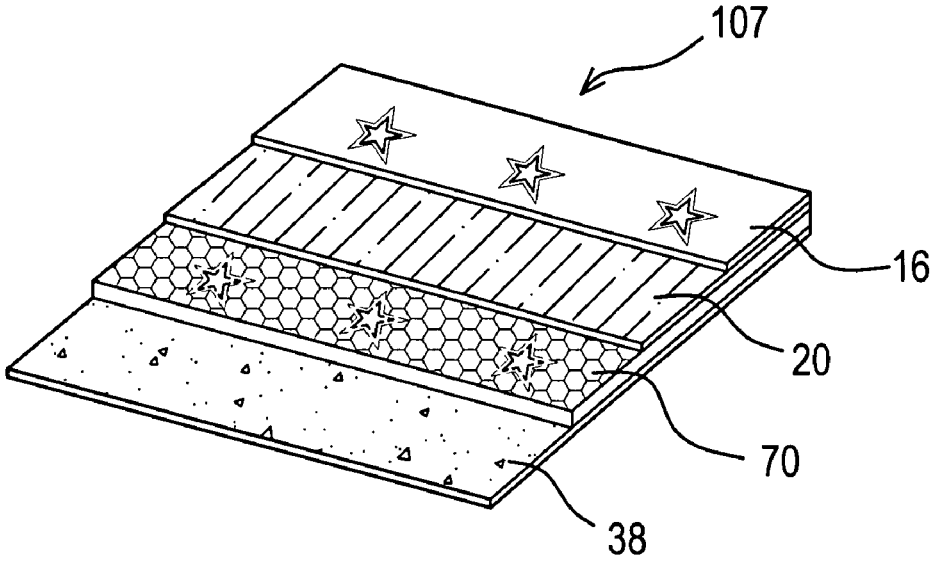
FIG. 7 is a partial perspective view of a sports board according to a seventh embodiment of the present invention.

FIG. 7 shows a sports board 107 according to a seventh embodiment of the present invention. Board 107 comprises top polyethylene film 16, which is bonded with adhesive resin film 20 to a substrate of polyethylene foam sheet 70 having a thickness of between 1 and 8 mm, and preferably a thickness of 5 mm. Foam sheet 70 has a density in the range of 1.5 to 12 lb/ft$^3$, and preferably a density of 8 lb/ft$^3$. To the bottom of foam sheet 70 is adhered PE sheet 38.

Here, an appropriate graphic may be printed on either the PE film 16 or the PE foam sheet 70.

Figure 8:
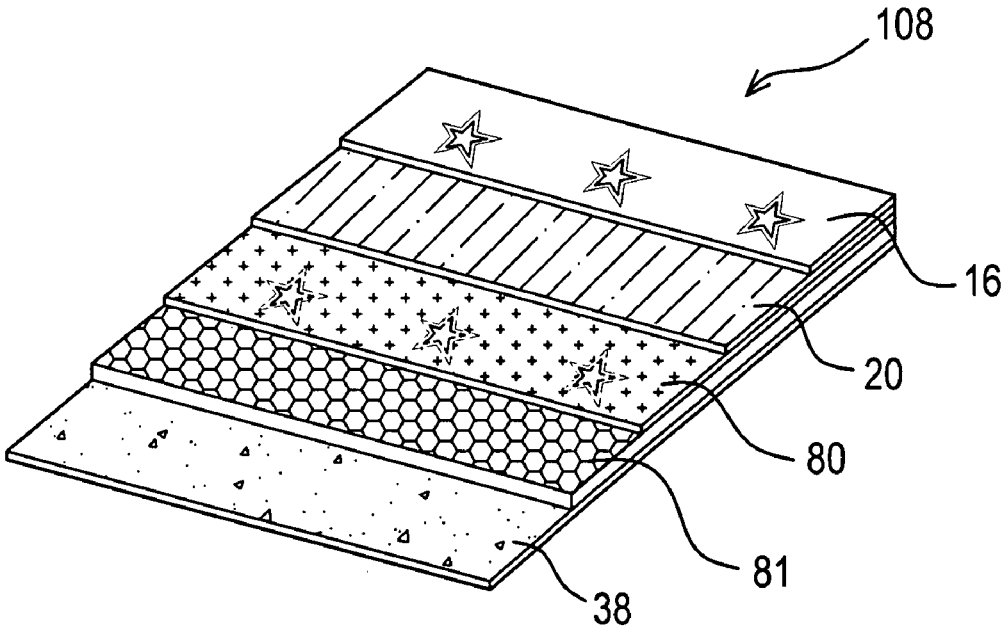
FIG. 8 is a partial perspective view showing an alternative sports board according to an eighth embodiment of the present invention.

FIG. 8 shows a sports board 108 according to an eighth embodiment comprising top polyethylene film 16, which is bonded with adhesive resin film 20 to cross-linked PE foam sheet 80. Foam sheet 80 has a thickness of between 1 and 8 mm, and preferably a thickness of 3 mm with its density being in the range of 1.5 to 12 lb/ft$^3$, and preferably 8 lb/ft$^3$. To the bottom of foam sheet 80 is adhered PE sheet 38 and another polyethylene foam sheet 81 having a thickness of between 2 and 50 mm. Foam sheet 81 has a density in the range of 2 to 8 lb/ft$^3$.

A graphic image may be printed on either the PE film 16 or the PE foam sheet 80.

Figure 9:
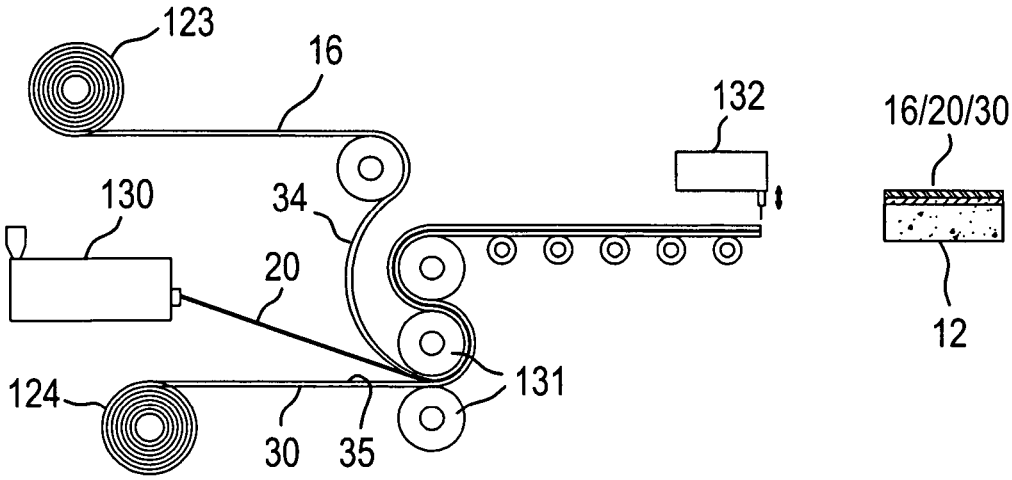
FIG. 9 is a schematic view of a first manufacturing step of making the third embodiment of the present invention.

The manufacturing steps of making the third embodiment are described here to provide an illustrative example. Sports board 103 is formed in a series of steps. First, polyethylene film layer 16 is imprinted with the desired graphics using a conventional imprinting process. With reference to FIG. 9, polyethylene film layer 16 is fed from a top roll 123 and polypropylene foam layer 30 is fed from bottom roll 124. As laminate layer 16 and layer 30 are fed from rolls 123 and 124, respectively, hot adhesive resin 20 is extruded, using a conventional extruder 130, between surface 34 of layer 16 and surface 35 of layer 30 as they pass nib rollers 131 to form a top laminate sheet of layers 16/20/30.

Figure 10:
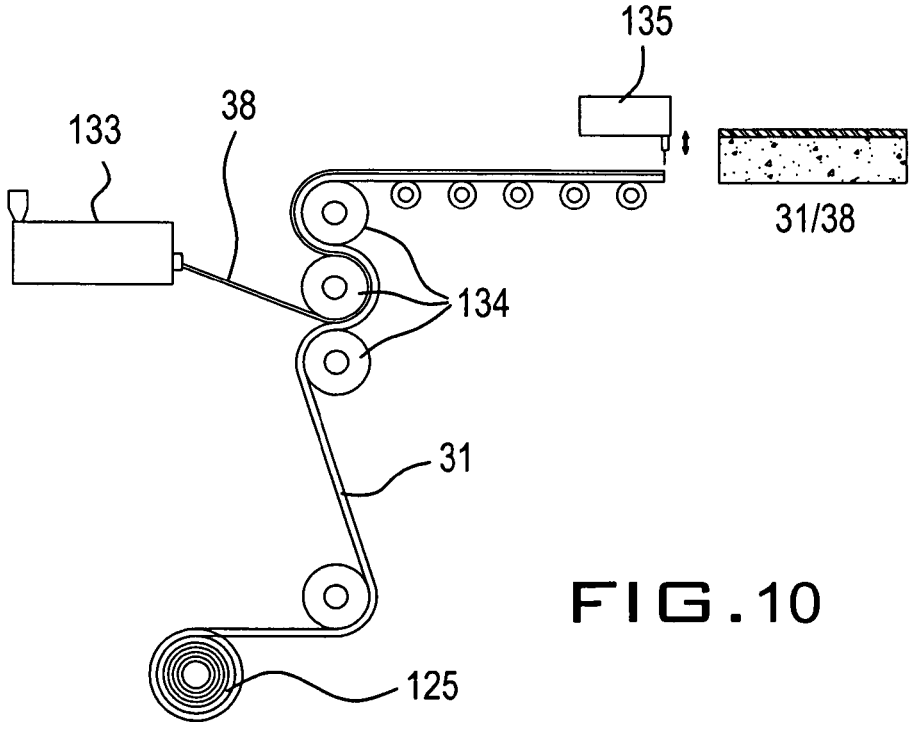
FIG. 10 is a schematic view of a first manufacturing step of making the third embodiment of the present invention.

The top laminate of layers 16/20/30 are then sized at a cutting station 132 so that its outer edge will extend over the peripheral edge of core 12 enough so that it can be wrapped over, and heat laminated to the top surface and edge surface of the polyethylene foam core 12. On the other hand, as shown in FIG. 10, polyethylene sheet layer 38 is extruded from another conventional extruder 133 and heat laminated with rollers 134 to polyethylene foam sheet layer 31 fed from bottom roll 125 to produce a bottom laminate 31/38.

Figure 11:
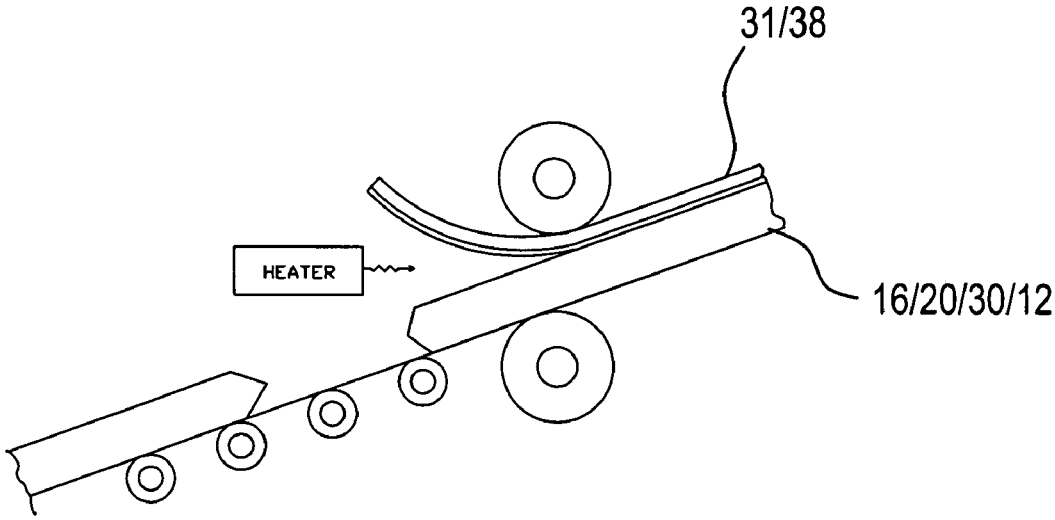
FIG. 11 is a schematic view of a first manufacturing step of making the third embodiment of the present invention.

Sized at cutting station 135, the bottom laminate is then heat laminated to the bottom surface of core 12 of the top laminate sheet 16/20/30. This heat laminating process is illustrated in FIG. 11 wherein top laminate sheets are conveyed toward a pair of nib rollers as the bottom laminate joins the top laminate to pass through the rollers with a supply of bonding heat blown between the two laminates that are welded under the pressure.

Alternatively, following the printing of the first polyethylene film 16, a second polyethylene film 40 may be bonded to the graphics imprinted in the first polyethylene film 16 by using conventional glue or adhesive so that the graphic is covered. The resulting dual-layered graphic polyethylene film is similarly laminated to the polypropylene foam sheet 30 by extruding an adhesive resin film layer 20 in between.

A third alternative way to provide a graphic image on the skin of sports board is to apply ink to the outer surface of the polypropylene foam sheet 30 by any conventional printing technique known in the art. The ink applied to polypropylene foam sheet 30 surface must be compatible to polyolefin. The graphic imprinted foam sheet is then laminated to the polyethylene film 16 by extruding an adhesive resin film layer 20 in between. The polyethylene film 16 acts as a protective film to protect the graphic image printed on the polypropylene foam sheet 30 from wear and tear.

A fourth alternative way to provide a graphic image on the skin of sports board is to apply a thin coating of adhesive resin to the outer surface of the polypropylene foam sheet 30 by extruding a thin film layer of adhesive resin onto the graphic image receiving surface of the polypropylene foam sheet. The coating process is also illustrated in FIG. 10. After that ink is applied to the outer surface of the adhesive resin coating. A graphic image is therefore formed on the adhesive resin coated surface of the polypropylene foam sheet. The graphic imprinted foam sheet is similarly laminated to the polyethylene film 16 by extruding an adhesive resin film layer 20 in between. The additional adhesive resin coating layer provides a smoother printing surface and at the same time enhance the bond strength between the ink resin and the polypropylene foam sheet. Therefore the present invention provides a sports board with high-resolution graphic image imprinted and improved bonding characteristic.

Therefore, while the presently preferred forms of the sports board and its derivative have been shown and described, and several modifications thereof discussed, persons skilled in this art will readily appreciate that various additional changes and modifications may be made without departing from the spirit of the invention, as defined and differentiated by the following claims.

For example, the sports board 102 of the second embodiment may have its bottom laminate replaced by the bottom laminate of the board 103 of the third embodiment. The sports board 105 of the fifth embodiment may have its bottom laminate replaced by the bottom laminate of the board 104 of the fourth embodiment. The sports board 106 of the sixth embodiment may have the bottom laminate of the board 104 of the fourth embodiment; and so on.

The invention claimed is:

1. A sports board for use on a gliding surface comprising:

a) a foam core having a thickness generally in the range of 0.2 inch to 4 inches;

b) an adhesive resin film having a first surface and second surface, the first surface is bonded to the foam core;

c) a plastic film having a first surface and second surface, the first surface is bonded to the second surface of the adhesive resin film; and d) a graphic image printed on the first surface of the plastic film, the graphic image visible from outside of the plastic film, whereby the graphic image imprinted surface is overlaid and bonded to the adhesive resin film; wherein the foam core is polystyrene foam or polystyrene copolymer foam, the foam sheet is polyolefin foam and the adhesive resin film is vinyl/acrylic copolymer.

2. The sports board of claim 1, further comprising: a plastic sheet heat laminated to an outside surface of the plastic film and, wherein the plastic sheet provides an outer slick running surface of the board for reducing friction and increasing mechanical strength.

3. The sports board of claim 1, further comprising: a plastic sheet heat laminated to the foam core and the plastic sheet provides an outer slick running surface of the board for reducing friction and increasing mechanical strength.

4. A sports board for use on a gliding surface comprising:

a) a foam core having a thickness generally in the range of 0.2 inch to 4 inches;

b) a foam sheet having a first surface and second surface, the first surface is bonded to the foam core; wherein the foam sheet has a density in the range of about 1.5 to 10 lb/ft$^3$ and has a higher density than the foam core;

c) an adhesive resin film having a first surface bonded to second surface of the foam sheet and a second surface; and d) a plastic film having a first surface and second surface, the first surface bonded to the second surface of the adhesive resin film;

e) a graphic image printed on the first surface of the plastic film, the graphic image visible from outside of the plastic film, whereby the graphic image imprinted surface is overlaid and bonded to the adhesive resin film; wherein the foam core is polystyrene foam or polystyrene copolymer foam, and the adhesive resin film is vinyl/acrylic copolymer.

5. The sports board of claim 4, further comprising: a plastic sheet heat laminated to an outside surface of the plastic film and, wherein the plastic sheet provides an outer slick running surface of the board for reducing friction and increasing mechanical strength.

6. The sports board of claim 4, further comprising: a plastic sheet heat laminated to the foam core and the plastic sheet provides an outer slick running surface of the board for reducing friction and increasing mechanical strength.

7. The sports board of claim 4, wherein the foam sheet is a first polyethylene foam sheet and has a top surface heat laminated to a bottom surface of a first adhesive resin film and a bottom surface heat laminated to the top surface and edge surfaces of the foam core, the first polyethylene foam sheet having a greater density than the foam core;

further comprising a second polyethylene foam having a top surface heat laminated to a bottom surface of the foam core and a bottom surface; and a plastic sheet having a top surface heat laminated to a bottom surface of the second polyethylene foam sheet, wherein the polyethylene foam sheet has a greater density than the foam core.

8. The sports board of claim 4, further comprising a second adhesive resin film having a top surface heat laminated to a bottom surface of a non-polyethylene foam sheet and a bottom surface heat laminated to the top surface and edge surfaces of the foam core, the non-polyethylene foam sheet having a top surface heat laminated to a bottom surface of a first adhesive resin film and a bottom surface heat laminated to a top surface of a second adhesive resin film, the non-polyethylene foam sheet having a greater density than the foam core; and a polyethylene foam having a top surface heat laminated to a bottom surface of the foam core and a bottom surface; and a plastic sheet having a top surface heat laminated to the bottom surface of the polyethylene foam sheet, wherein the polyethylene foam sheet has a greater density than the density of the foam core.

9. The sports board of claim 4, wherein the foam core is non-polyethylene, and the foam sheet is polyolefin foam, wherein the foam core is polystyrene foam or polystyrene copolymer foam, the foam sheet is polyolefin foam and the adhesive resin is vinyl/acrylic copolymer.

10. The sports board of claim 9, further comprising a second adhesive resin film having a top surface heat laminated to the bottom surface of the polyolefin foam sheet and a bottom surface heat laminated to the top surface and edge surfaces of the non-polystyrene foam core, the polyolefin foam sheet having a top surface heat laminated to the bottom surface of the first adhesive resin film and a bottom surface heat laminated to the top surface of the second adhesive resin film, the polyolefin foam sheet having a greater density than the density of the foam core; and a third adhesive resin film having a top surface heat laminated to the bottom surface of the foam core and a bottom surface, a polyethylene foam having a top surface heat laminated to the bottom surface of the third adhesive resin film and a bottom surface, and a plastic sheet having a top surface heat laminated to the bottom surface of the polyethylene foam sheet, wherein the polyethylene foam sheet has a greater density than the density of the foam core.

11. A sports board for use on a gliding surface comprising:

a) a foam core having a thickness generally in the range of 0.2 inch to 4 inches;

b) a foam sheet having an first surface and second surface, the first surface is bonded to the foam core, wherein the foam sheet has a density in the range of about 1.5 to 10 $lb/ft^3$ and has a higher density than the foam core;

c) a graphic image printed on the second surface of the foam sheet, the graphic image being visible from outside of the sports board;

d) an adhesive resin film having a first surface bonded to the second surface of the foam sheet, whereby the graphic image imprinted surface is overlaid and bonded to the adhesive resin; and e) a plastic film bonded to the second surface of the adhesive resin film;

f) further comprising a bottom third adhesive resin film layer bonded to the bottom side of the foam core, wherein the foam sheet is bonded to a top surface of the foam core;

g) a bottom polyethylene foam sheet bonded to the bottom third adhesive resin film layer;

h) a bottom fourth adhesive resin film layer bonded to the bottom polyethylene foam sheet;

i) a bottom plastic film bonded to the bottom fourth adhesive resin film layer, wherein the bottom plastic film is transparent with a graphic printed on an inner surface of the bottom plastic film layer; and j) a bottom plastic sheet bonded to the bottom plastic film layer, wherein the bottom plastic sheet is transparent.

12. The sports board of claim 11, further comprising: a plastic sheet heat laminated to an outer surface of the plastic film and, wherein the plastic sheet provides an outer slick running surface of the board for reducing friction and increasing mechanical strength.

13. The sports board of claim 11, further comprising: a plastic sheet heat laminated to the foam core and the plastic sheet provides an outer slick running surface of the board for reducing friction and increasing mechanical strength.

14. The sports board of claim 11, wherein the foam core is polyethylene, and the foam sheet is polyethylene.

15. The sports board of claim 14, wherein the first polyethylene foam sheet has a top surface heat laminated to the bottom surface of the first adhesive resin film and a bottom surface heat laminated to the top surface and edge surfaces of the polyethylene foam core, the first polyethylene foam sheet having a greater density than the density of the foam core; and the sports board further comprising a second polyethylene foam having a top surface heat laminated to the bottom surface of the foam core and a bottom surface; and a plastic sheet having a top surface heat laminated to the bottom surface of the polyethylene foam sheet, wherein the polyethylene foam sheet has a greater density than a density of the foam core.

16. The sports board of claim 11, further comprising a second adhesive resin film having a top surface heat laminated to the bottom surface of the non-polyethylene foam sheet and a bottom surface heat laminated to the top surface and edge surfaces of the polyethylene foam core, the non-polyethylene foam sheet having a top surface heat laminated to the bottom surface of the first adhesive resin film and a bottom surface heat laminated to the top surface of the second adhesive resin film, the non-polyethylene foam sheet having a greater density than the density of the foam core; and a polyethylene foam having a top surface heat laminated to the bottom surface of the foam core and a bottom surface; and a plastic sheet having a top surface heat laminated to the bottom surface of the third adhesive resin film and a of the polyethylene foam sheet, wherein the polyethylene foam sheet has a greater density than the density of the foam core.

17. The sports board of claim 11, wherein the foam core is non-polyethylene, and the foam sheet is polyolefin foam.

18. The sports board of claim 17, further comprising a second adhesive resin film having a top surface heat laminated to the bottom surface of the polyolefin foam sheet and a bottom surface heat laminated to the top surface and edge surfaces of the non-polyethylene foam core, the polyolefin foam sheet having a top surface heat laminated to the bottom surface of the first adhesive resin film and a bottom surface heat laminated to the top surface of the second adhesive resin film, the polyolefin foam sheet having a greater density than the density of the foam core; and a third adhesive resin film having a top surface heat laminated to the bottom surface of the foam core and a bottom surface, a polyethylene foam having a top surface heat laminated to the bottom surface of the third adhesive resin film and a bottom surface, and a plastic sheet having a top surface heat laminated to the bottom surface of the polyethylene foam sheet, wherein the polyethylene foam sheet has a greater density than the density of the foam core.

19. A sports board for use on a gliding surface comprising:

a) a foam core having a thickness generally in the range of 0.2 inch to 4 inches;

b) a foam sheet having an first surface and second surface, the first surface bonded to the foam core, wherein the foam sheet has a density in the range of about 1.5 to 10 $lb/ft^3$ and has a higher density than the foam core;

c) a second adhesive resin film having an first surface and second surface, the first surface bonded to the foam sheet;

d) a graphic image printed on the second surface of the second adhesive resin film, the graphic image visible from outside of the sports board;

e) a first adhesive resin film having a first surface bonded to the second surface of the second adhesive resin film, whereby the graphic image imprinted surface is overlaid and bonded to the first adhesive resin; and f) a plastic film bonded to the second surface of the adhesive resin film.

20. The sports board of claim 19, further comprising: a plastic sheet heat laminated to an outer surface of the plastic film and, wherein the plastic sheet provides an outer slick running surface of the board for reducing friction and increasing mechanical strength.

21. The sports board of claim 19, further comprising: a plastic sheet heat laminated to the foam core and the plastic sheet provides an outer slick running surface of the board for reducing friction and increasing mechanical strength.

22. The sports board of claim 19, wherein the foam core is polyethylene, the foam sheet is polyethylene.

23. The sports board of claim 22, wherein the first polyethylene foam sheet has a top surface heat laminated to the bottom surface of the second adhesive resin film and a bottom surface heat laminated to the top surface and edge surfaces of the polyethylene foam core, the first polyethylene foam sheet having a greater density than the density of the foam core; and the sports board further comprising a second polyethylene foam having a top surface heat laminated to the bottom surface of the foam core and a bottom surface; and a plastic sheet having a top surface heat laminated to the bottom surface of the polyethylene foam sheet, wherein the polyethylene foam sheet has a greater density than a density of the foam core.

24. The sports board of claim 19, wherein the foam core is polyethylene, and the foam sheet is non-polyethylene.

25. The sports board of claim 24, further comprising a third adhesive resin film having a top surface heat laminated to the bottom surface of the non-polyethylene foam sheet and a bottom surface heat laminated to the top surface and edge surfaces of the polyethylene foam core, the non-polyethylene foam sheet having a top surface heat laminated to the bottom surface of the second adhesive resin film and a bottom surface heat laminated to the top surface of the third adhesive resin film, the non-polyethylene foam sheet having a greater density than the density of the foam core; and a polyethylene foam having a top surface heat laminated to the bottom surface of the foam core and a bottom surface; and a plastic sheet having a top surface heat laminated to the bottom surface of the polyethylene foam sheet, wherein the polyethylene foam sheet has a greater density than the density of the foam core.

26. The sports board of claim 19, wherein the foam core is non-polyethylene, and the foam sheet is polyolefin foam.

27. The sports board of claim 26, further comprising a third adhesive resin film having a top surface heat laminated to the bottom surface of the polyolefin foam sheet and a bottom surface heat laminated to the top surface and edge surfaces of the non-polyethylene foam core, the polyolefin foam sheet having a top surface heat laminated to the bottom surface of the second adhesive resin film and a bottom surface heat laminated to the top surface of the third adhesive resin film, the polyolefin foam sheet having a greater density than the density of the foam core; and a fourth adhesive resin film having a top surface heat laminated to the bottom surface of the foam core and a bottom surface, a polyethylene foam having a top surface heat laminated to the bottom surface of the fourth adhesive resin film and a bottom surface, and a plastic sheet having a top surface heat laminated to the bottom surface of the polyethylene foam sheet, wherein the polyethylene foam sheet has a greater density than the density of the foam core.

28. A sports board for use on a gliding surface comprising:

a) a foam sheet having a thickness generally in the range of 1 mm to 13 mm;

b) a graphic image printed on the foam sheet, the graphic image visible from outside of the sports board;

c) an adhesive resin film having a first surface bonded to the foam sheet, whereby the graphic image imprinted surface is overlaid and bonded to the adhesive resin; and d) a plastic film bonded to the second surface of the adhesive resin film.

29. The sports board of claim 28, further comprising: a plastic sheet heat laminated to an outer surface of the plastic film and, wherein the plastic sheet provides an outer slick running surface of the board for reducing friction and increasing mechanical strength.

30. The sports board of claim 28, further comprising: a plastic sheet heat laminated to the foam core and the plastic sheet provides an outer slick running surface of the board for reducing friction and increasing mechanical strength.

31. A sports board for use on a gliding surface comprising:

a) a foam sheet having a thickness generally in the range of 1 mm to 13 mm;

b) a second adhesive resin film having a first surface and second surface, the first surface is bonded to the foam sheet;

c) a graphic image printed on the second surface of the second adhesive resin film, the graphic image visible from outside of the sports board;

d) a first adhesive resin film having a first surface bonded to the second surface of the second adhesive resin film, whereby the graphic image imprinted surface is overlaid and bonded to the first adhesive resin; and e) a plastic film bonded to the second surface of the first adhesive resin film.

32. The sports board of claim 31, further comprising: a plastic sheet heat laminated to an outer surface of the plastic film and, wherein the plastic sheet provides an outer slick running surface of the board for reducing friction and increasing mechanical strength.

33. The sports board of claim 31, further comprising: a plastic sheet heat laminated to the foam core and the plastic sheet provides an outer slick running surface of the board for reducing friction and increasing mechanical strength.

* * * * *